US005909825A

United States Patent [19]

Lydford

[11] Patent Number: 5,909,825

[45] Date of Patent: Jun. 8, 1999

[54] BEVERIDGE DISPENSING SYSTEM

[76] Inventor: Steven R. Lydford, 1A First Floor 12th St. Aubyns, Hove, Sussex, United Kingdom, BN3 2TB

[21] Appl. No.: 08/842,763

[22] Filed: Apr. 17, 1997

[51] Int. Cl.[6] ..... B67D 5/08

[52] U.S. Cl. ..... 222/67; 116/110

[58] Field of Search ..... 340/623, 624; 116/110; 222/51, 67

[56] References Cited

U.S. PATENT DOCUMENTS

| | | | |
|---|---|---|---|
| 618,740 | 1/1899 | Schroeder | 116/110 |
| 4,337,246 | 3/1983 | McMillin et al. | 222/67 X |
| 5,511,694 | 4/1996 | Rohm | 222/36 |

*Primary Examiner*—Gregory L. Hudson

[57] ABSTRACT

A new beverage dispensing system for permitting an uninterrupted flow of a beverage when a beverage container is low on, or runs out of, a beverage. The inventive device includes first and second beverage containers and a dispenser connected to the containers. A system of valves control the flow of beverages from the containers to the dispenser, and manually actuated switches are used to control the valves. A float type of sensor is situated inside each of the beverage containers for sensing the amount of beverage remaining within the containers, and the sensors actuate a signal system for signaling when the amount of beverage remaining within the container reaches a predetermined level. The system is configured such that the beverage in the first container is initially dispensed from the dispenser. When the sensor within the first container senses that the beverage is almost gone, the signal system is actuated thus indicating this low, or empty, condition. The valves are then actuated by the manual switches so as to close the first container and open the second container such that the beverage from the second container is dispensed by the dispenser. The first beverage container can then be replaced, or refilled, when convenient, for later use when the second container runs low or becomes empty.

16 Claims, 2 Drawing Sheets

BEVERIDGE DISPENSING SYSTEM

BACKGROUND OF THE INVENTION

1. Field of the Invention

The present invention relates to beverage dispensing systems and more particularly pertains to a new beverage dispensing system for permitting an uninterrupted flow of a beverage when a beverage container is low on, or runs out of, a beverage.

2. Description of the Prior Art

The use of beverage dispensing systems is known in the prior art. More specifically, beverage dispensing systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art beverage dispensing systems include U.S. Pat. No. 5,007,560; U.S. Pat. No. 4,997,012; U.S. Pat. No. 4,512,377; U.S. Pat. No. 4,887,651; U.S. Pat. No. 5,332,132; and U.S. Pat. Des. No. 247,905.

While these devices fulfill their respective, particular objectives and requirements, the aforementioned patents do not disclose a new beverage dispensing system. The inventive device includes first and second beverage containers and a dispenser connected to the containers. A system of valves control the flow of beverages from the containers to the dispenser, and manually actuated switches are used to control the valves. A float type of sensor is situated inside each of the beverage containers for sensing the amount of beverage remaining within the containers, and the sensors actuate a signal system for signaling when the amount of beverage remaining within the container reaches a predetermined level. The system is configured such that the beverage in the first container is initially dispensed from the dispenser. When the sensor within the first container senses that the beverage is almost gone, the signal system is actuated thus indicating this low, or empty, condition. The valves are then actuated by the manual switches so as to close the first container and open the second container such that the beverage from the second container is dispensed by the dispenser. The first beverage container can then be replaced, or refilled, when convenient, for later use when the second container runs low or becomes empty.

In these respects, the beverage dispensing system according to the present invention substantially departs from the conventional concepts and designs of the prior art, and in so doing provides an apparatus primarily developed for the purpose of permitting an uninterrupted flow of a beverage when a beverage container is low on, or runs out of, a beverage.

SUMMARY OF THE INVENTION

In view of the foregoing disadvantages inherent in the known types of beverage dispensing systems now present in the prior art, the present invention provides a new beverage dispensing system construction wherein the same can be utilized for permitting an uninterrupted flow of a beverage when a beverage container is low on, or runs out of, a beverage.

The general purpose of the present invention, which will be described subsequently in greater detail, is to provide a new beverage dispensing system which has many of the advantages of the beverage dispensing systems mentioned heretofore and many novel features that result in a new beverage dispensing system which is not anticipated, rendered obvious, suggested, or even implied by any of the prior art beverage dispensing systems, either alone or in any combination thereof.

To attain this, the present invention generally comprises first and second beverage containers and a dispenser connected to the containers. A system of valves control the flow of beverages from the containers to the dispenser, and manually actuated switches are used to control the valves. A float type of sensor is situated inside each of the beverage containers for sensing the amount of beverage remaining within the containers, and the sensors actuate a signal system for signaling when the amount of beverage remaining within the container reaches a predetermined level. The system is configured such that the beverage in the first container is initially dispensed from the dispenser. When the sensor within the first container senses that the beverage is almost gone, the signal system is actuated thus indicating this low, or empty, condition. The valves are then actuated by the manual switches so as to close the first container and open the second container such that the beverage from the second container is dispensed by the dispenser. The first beverage container can then be replaced, or refilled, when convenient, for later use when the second container runs low or becomes empty.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage dispensing system which has many of the advantages of the beverage dispensing systems mentioned heretofore and many novel features that result in a new beverage dispensing system which is not anticipated, rendered obvious, suggested, or even implied by any of the prior art beverage dispensing systems, either alone or in any combination thereof.

It is another object of the present invention to provide a new beverage dispensing system which may be easily and efficiently manufactured and marketed.

It is a further object of the present invention to provide a new beverage dispensing system which is of a durable and reliable construction.

An even further object of the present invention is to provide a new beverage dispensing system which is susceptible of a low cost of manufacture with regard to both materials and labor, and which accordingly is then susceptible of low prices of sale to the consuming public, thereby making such beverage dispensing system economically available to the buying public.

Still yet another object of the present invention is to provide a new beverage dispensing system which provides in the apparatuses and methods of the prior art some of the advantages thereof, while simultaneously overcoming some of the disadvantages normally associated therewith.

Still another object of the present invention is to provide a new beverage dispensing system for permitting an uninterrupted flow of a beverage when a beverage container is low on, or runs out of, a beverage.

Yet another object of the present invention is to provide a new beverage dispensing system which includes first and second beverage containers and a dispenser connected to the containers. A system of valves control the flow of beverages from the containers to the dispenser, and manually actuated switches are used to control the valves. A float type of sensor is situated inside each of the beverage containers for sensing the amount of beverage remaining within the containers, and the sensors actuate a signal system for signaling when the amount of beverage remaining within the container reaches a predetermined level. The system is configured such that the beverage in the first container is initially dispensed from the dispenser. When the sensor within the first container senses that the beverage is almost gone, the signal system is actuated thus indicating this low, or empty, condition. The valves are then actuated by the manual switches so as to close the first container and open the second container such that the beverage from the second container is dispensed by the dispenser. The first beverage container can then be replaced, or refilled, when convenient, for later use when the second container runs low or becomes empty.

Still yet another object of the present invention is to provide a new beverage dispensing system that saves time and money by permitting a continuous flow of a beverage. The system permits switching over to a second beverage container when a first one runs out, thus allowing the first container to be changed or refilled when it is convenient.

Even still another object of the present invention is to provide a new beverage dispensing system that reduces the spillage, and thus waste, of beverages which results from a hurried change of a beverage container. This system allows the empty container to be changed in a calm manner and without pressure, since the user can wait until a less busy time to change the empty container while assuring that plenty of beverage remains for customers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
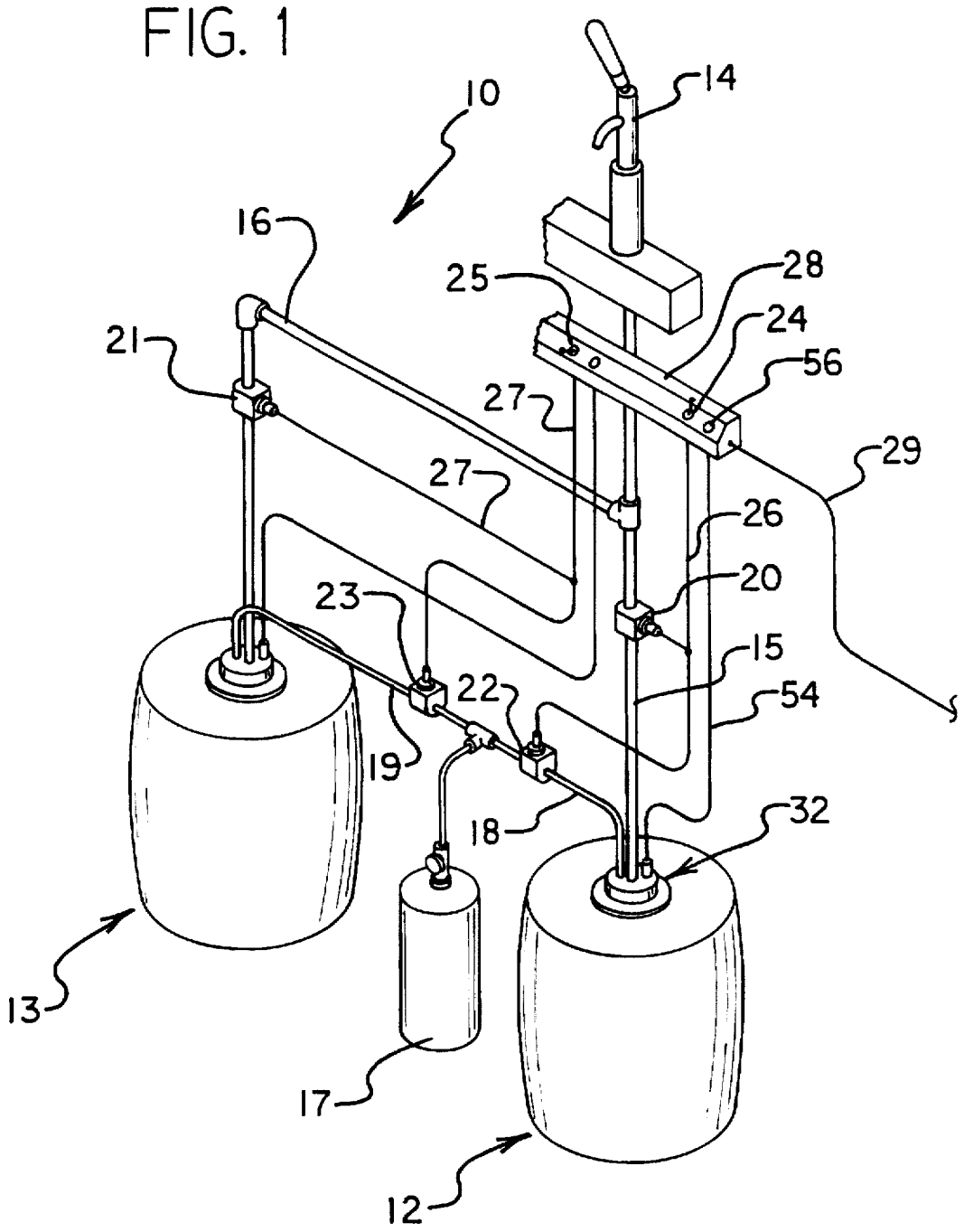
FIG. 1 is a perspective view of a new beverage dispensing system according to the present invention.
Figure 2:
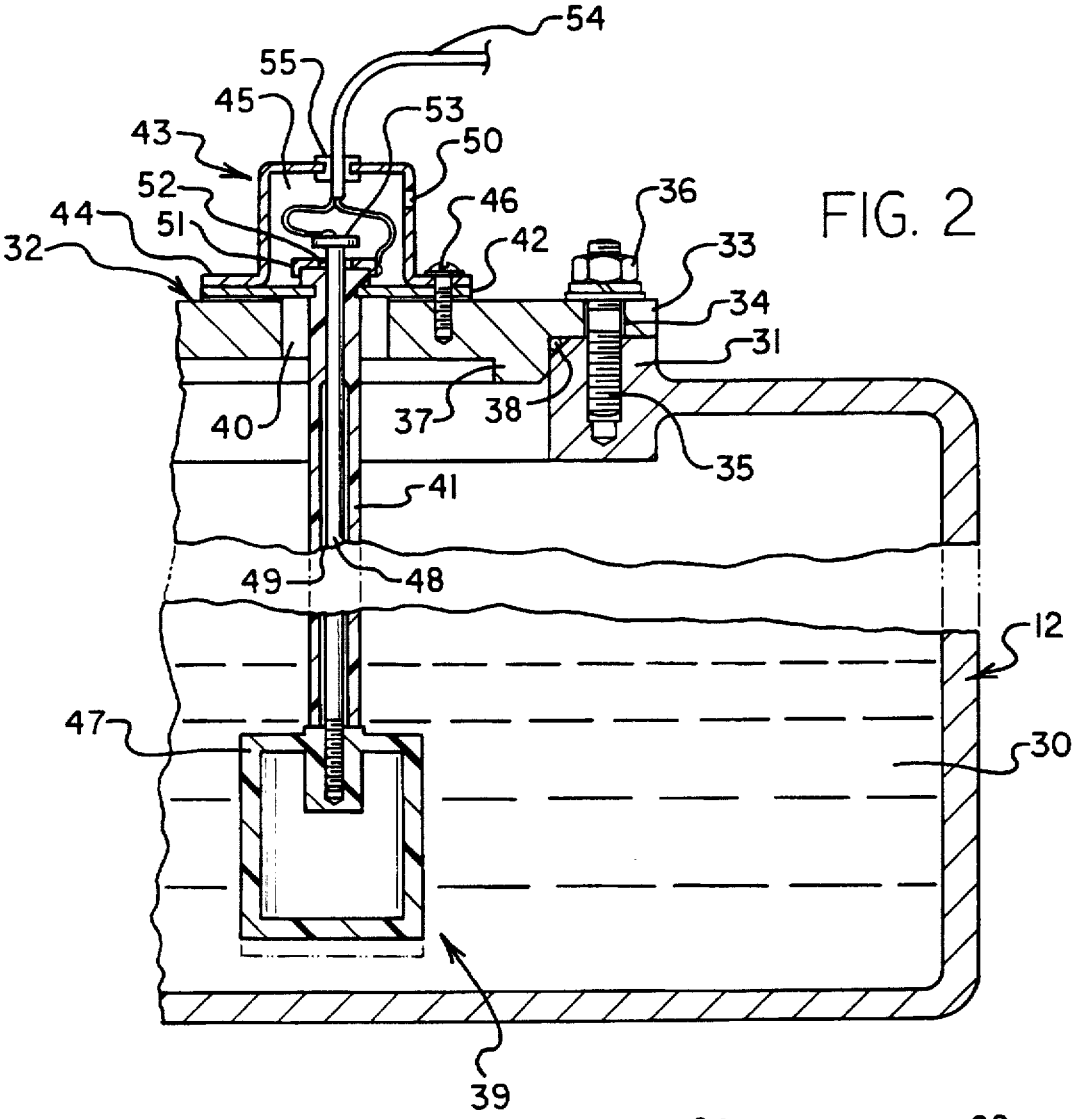
FIG. 2 is a partial sectional view of one of the beverage containers showing the float sensor and part of the signaling system.
Figure 3:
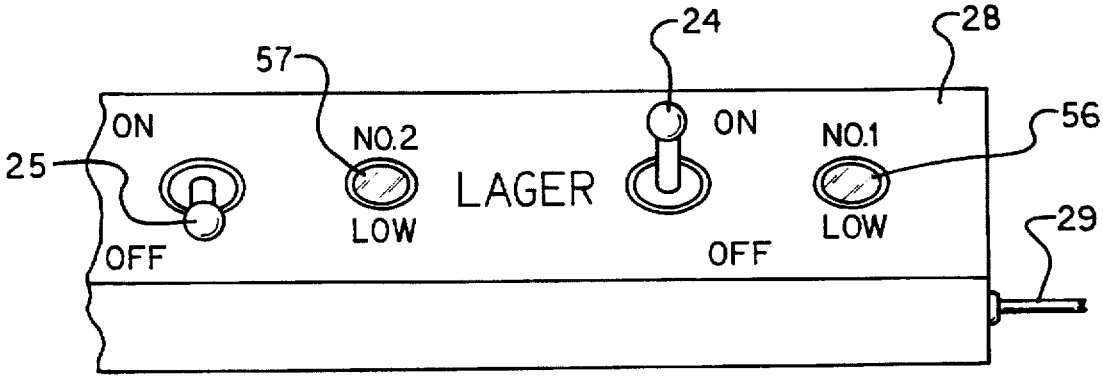
FIG. 3 is a partial front view of the control panel used with the present invention.

With reference now to the drawings, and in particular to FIGS. 1 through 3 thereof, a new beverage dispensing system embodying the principles and concepts of the present invention and generally designated by the reference numeral 10 will be described.

As best illustrated in FIGS. 1 through 3, the beverage dispensing system 10 comprises a first, or primary, beverage container 12 and a second, or secondary, beverage container 13 for supplying a beverage to be dispensed from a conventional type of dispenser 14. The containers 12,13 can be filled with any type of beverage, such as beer or soda. The invention is particularly useful in bars, taverns, nightclubs, and the like, for dispensing beer. The containers 12,13 can be conventional beer kegs of any convenient capacity.

A conduit 15 extends from the container 12 to the dispenser 14 for directing the beverage from the container to the dispenser. An additional conduit 16 extends from the container 13 and leads into the conduit 15 for use when beverage is being supplied by the container 13. A cylinder 17 containing pressurized gas is connected by conduits 18,19 to each of the containers 12,13 for pressurizing the beverages within the containers, as is conventional.

Each of the conduits 15,16 include a solenoid operated on/off valve 20,21 associated therewith for controlling flow through the conduits. The conduits 18,19 also each include a solenoid operated on/off valve 22,23 associated therewith for controlling the flow of pressurized gas to the containers 12,13. The valves 20–23 can be any type of conventional solenoid operated valve having two positions, either on (open) or off (closed). The valves 20–23 are operated by a pair of on/off switches 24,25 through suitable wiring 26,27, such that the switch 24 simultaneously controls operation of the valves 20,22 and the switch 25 simultaneously controls operation of the valves 21,23. The switches 24,25 are suitably mounted on a control panel 28 which should be located such that it is within easy view of a person operating the dispenser 14.

As best seen in FIG. 3, the control panel 28 is marked with indicia indicating the on and off positions of the switches 24,25, which correspond with the on and off positions of the valves 20–23. Electrical power for operating the valves 20–23 is provided by a power supply line 29 leading into the control panel 28.

The valves 20–23 and switches 24,25 thus constitute a means for controlling flow through the conduits 15–16, 18–19. The valves and switches have an initial configuration where the beverage within the container 12 is allowed to flow to the dispenser 14 and the beverage within the container 13 is prevented from flowing to the dispenser 14 (i.e. switch 24 "on" and valves 20,22 open; switch 25 "off" and valves 21,23 closed). When the container 12 is empty or runs low of beverage, the user who operates the dispenser 14 manually changes the switches and valves to a back-up configuration where the beverage within the container 13 is allowed to flow to the dispenser 14 (i.e. switch 24 "closed" and valves 20,22 closed; switch 25 "on" and valves 21,23 open).

A sensing means is provided within each of the containers 12,13 for sensing the amount of beverage which remains within the containers. The sensing means in each container are identical to each other so only one sensing means will be described in detail, it being understood that the sensing means in the other container is the same as the one described.

The sensing means 39 for the container 12 is shown in FIG. 2, the container 12 including a beverage 30 therein. The container 12 has an opening at the top thereof for permitting refilling of the container and general access to the interior thereof. A thickened rim 31 is formed around the opening, and a lid 32 is provided for closing the opening. The lid 32 includes a rim portion 33 which sits upon the thickened rim 31, and the rim portion includes a plurality of holes 34 spaced thereabout (only one being shown in the figure) which align with threaded holes in the rim 31. The threaded holes in the rim 31 receive threaded posts 35 which extend upward through the holes 34, and a lock nut 36 is used to securely fasten the lid 32 onto the container 12. The lid 32 further includes a central alignment and scaling boss 37 which fits just inside the inner perimeter of the rim 31. An o-ring seal 38 is located between the rim 31 and the boss 37 for assuring a tight seal between the lid 32 and the container 12.

The lid 32 further includes an opening 40 therein, through which extends an elongated sleeve 41. The sleeve 41 is mounted centrally within the opening 40 by a mounting plate 42 and extends down into the container 12. A cap member 43 having a rim 44 resting upon the plate 42 defines an interior space 45 between the cap member and the plate. A plurality of fasteners 46 (only one being shown in FIG. 2) extend through the rim 44 and plate 42, and engage with the lid 32, for securing the plate and cap member to the lid. The sleeve 41 is thus rigidly mounted to the plate 42 such that it cannot move relative thereto. A vent hole 50 is formed in the cap member 43 to allow venting of any vapors and gases which escape from the container.

The sensing means 39 itself is supported by the sleeve 41 for upward and downward movement within the container. The sensing means 39 includes a hollow float member 47 and a shaft 48 connected to the top thereof and freely extending upward through a central passage 49 within the sleeve and into the interior space 45. The float member 47 is preferably located closely adjacent the bottom of the container. As illustrated in FIG. 2, when the float member 47 is submerged in the beverage 30, the buoyancy force acting on the float member will cause the float member and shaft 48 to move upward to the position shown in full lines, where the top of the float member abuts the bottom of the sleeve 41. The float member and shaft will remain in this position until the beverage level starts dropping below the bottom of the float member, at which point the weight of the float member and shaft will cause the sensor means 39 to start dropping down following the decrease in the beverage level until a predetermined beverage level is reached, at which point a signal means is actuated to indicate that the predetermined level has been reached.

The signal means comprises a contact member 51 which is secured to the top of the sleeve 41, and which includes a hole 52 to allow free passage of the shaft 48. An additional contact member 53 is affixed to the end of the shaft 48 for movements therewith. Wiring 54 extends from each contact member 51,53 and through a seal member 55 in the top of the cap member 43, and connect with a warning signal light 56 mounted on the panel 28. The wiring 54 which is connected to the contact member 53 should include enough play to permit the upward and downward movements of the sensor means 39 over its entire range. The signal means is configured such that when the contacts are out of contact, as shown in FIG. 2, the electrical circuit is not completed to illuminate the signal light 56. However, as the beverage level drops, and the float member and shaft drop, the contacts 51,53 are moved closer and closer, until a predetermined beverage level is reached, at which point the contacts 51,53 engage, the circuit is completed, and the light 56 is illuminated, indicating that the container is almost empty, and that the other container should now be used.

As best shown in FIG. 3, a signal light 57 for the second container 13 is also mounted on the panel 28 for indicating a low, or empty, beverage condition in container 13. The panel 28 includes indicia adjacent to the lights 56,57 to indicate which container the respective light is associated with.

In use, as stated previously, the valves and switches are in the initial configuration so that the beverage from the container 12 is being dispensed. As the beverage level drops, and eventually reaches the bottom of the float member 47, the float and shaft will start dropping downward, following the drop in the beverage level. The float and shaft will drop until the contacts 51,53 engage, at which point the light 56 is illuminated, thus indicating a low, or empty, beverage condition in the container 12. The user then changes the switches and valves to the back-up configuration, preventing further flow from the container 12 and permitting flow from the container 13 which is full or nearly full. Thus an uninterrupted supply of beverage is provided. The container 12 can then be changed or refilled. The container 13 now acts as the main or primary container, until its beverage level drops to the predetermined level, which will be indicated by the light 57, at which point the user changes back to the container 12.

It should be realized that although the invention has been shown and described as using two containers, the invention is useful with any number of containers, depending upon how much beverage is being dispensed and how easily accessible the containers are.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A beverage dispensing system for uninteruptedly serving beverages by permitting remote switching from a nearly emptied primary beverage container to a full secondary beverage container, said beverage dispensing system comprising:

a primary beverage container and a secondary beverage container, each beverage container containing a beverage therein;

a beverage dispenser;

conduit means connected between the primary beverage container and the dispenser and between the secondary beverage container and the dispenser for directing the beverages from the primary container and the secondary container to the beverage dispenser;

sensing means for sensing the amount of beverage within the primary beverage container, wherein said sensing means comprises a float disposed inside of the primary beverage container;

signal means actuated by said float for generating a signal when the predetermined amount of beverage is reached, wherein said signal means comprises a first contact member connected to the float and a second contact member connected to the primary container, and a warning signal light being electrically connected to the first and the second contact members such that the signal light is illuminated when the first and the second contact members contact each other; and control means for controlling flow through the conduit means, said control means having an initial configuration where the beverage is allowed to flow from the primary container to the beverage dispenser and the beverage within the secondary container is prevented from flowing to the beverage dispenser, and said control means having a back-up configuration where the beverage is prevented from flowing from the primary container to the dispenser and the beverage is allowed to flow from the secondary container to the dispenser, the configuration of said control means being changed from the initial configuration to the back-up configuration by an operator when the sensing means senses that there is a predetermined amount of beverage remaining within the primary container.

2. The beverage dispensing system according to claim 1, wherein said control means comprises a first on/off valve in the conduit means between the primary container and the dispenser, and a second on/off valve in the conduit means between the secondary container and the dispenser, and switch means for controlling said first on/off valve and said second on/off valve.

3. The beverage dispensing system according to claim 2, wherein said switch means comprises a first on/off switch for controlling the first on/off valve, and a second on/off switch for controlling the second on/off valve.

4. The beverage dispensing system according to claim 3, wherein said first on/off switch and said second on/off switch are mounted on a control panel.

5. The beverage dispensing system according to claim 3, further including a pressurized gas supply connected to the beverage containers for pressurizing said primary container and said secondary container, said control means controlling the flow of pressurized gas to the primary container and the secondary container.

6. The beverage dispensing system according to claim 5, wherein said pressurized gas is supplied to the primary container in the initial configuration of said control means, and said pressurized gas is supplied to the secondary container in the back-up configuration of said control means.

7. The beverage dispensing system according to claim 5, further including first and second on/off gas supply valves for controlling the flow of pressurized gas from the pressurized gas supply to the beverage containers, said first on/off gas supply valve being controlled by the first on/off switch, and said second on/off gas supply valve being controlled by the second on/off switch.

8. The beverage dispensing system according to claim 1, wherein said float comprises a hollow, buoyant member.

9. The beverage dispensing system according to claim 4, further comprising a second sensing means for sensing the amount of beverage within the secondary container, said second sensing means comprising a float disposed inside of the secondary beverage container.

10. The beverage dispensing system according to claim 9, wherein said float comprises a hollow, buoyant member.

11. The beverage dispensing system according to claim 9, further comprising signal means actuated by said float for generating a signal when a predetermined amount of beverage remains within the secondary container.

12. The beverage dispensing system according to claim 4, wherein said sensing means further comprises a second float disposed inside of the second beverage container, said signal means further comprises a third contact member connected to the second float, a fourth contact member connected to the secondary container, and a second signal light connected to the control panel and being electrically connected to the first and the second contact members such that the second signal light is illuminated when the third and the fourth contact members contact each other.

13. The beverage dispensing system according to claim 1, wherein a lid of the primary beverage container comprises a plate, a pair of generally cylindrical cap members, the cap member coupled to the lid of respective container and having a closed upper end, a perimeter sidewall, and an interior being defined by said sidewall, a pair of cylindrical sleeves, each of the sleeves being downwardly extended from a respective lid of the containers, each of the floats comprising a hollow float member and a shaft connected to a top thereof, each of the shafts being slidably received in the respective sleeve and extending into the interior of the respective cap member, the first contact member being coupled to a top of the respective sleeve, the shaft of the float extending through an aperture in the first contact member, the second contact member being coupled to a top of the respective shaft.

14. The beverage dispensing system according to claim 13, wherein a vent hole extends through each of the lids.

15. A beverage dispensing system for uninteruptedly serving beverages by permitting remote switching from a nearly emptied primary beverage container to a full secondary beverage container, said beverage dispensing system comprising:

a primary beverage container and a secondary beverage container, each beverage container containing a beverage therein;

a beverage dispenser;

conduit means connected between the primary beverage container and the dispenser and between the secondary beverage container and the dispenser for directing the beverages from the primary container and the secondary container to the beverage dispenser;

sensing means for sensing the amount of beverage within the primary beverage container, wherein said sensing means comprises a float disposed inside of the primary beverage container;

signal means actuated by said float for generating a signal when the predetermined amount of beverage is reached;

control means for controlling flow through the conduit means, said control means having an initial configuration where the beverage is allowed to flow from the primary container to the beverage dispenser and the beverage within the secondary container is prevented from flowing to the beverage dispenser, and said control means having a back-up configuration where the beverage is prevented from flowing from the primary container to the dispenser and the beverage is allowed to flow from the secondary container to the dispenser, the configuration of said control means being changed from the initial configuration to the back-up configuration by an operator when the sensing means senses that there is a predetermined amount of beverage remaining within the primary container;

wherein said control means comprises a first on/off valve in the conduit means between the primary container and the dispenser, and a second on/off valve in the conduit means between the secondary container and the dispenser, and switch means for controlling said first on/off valve and said second on/off valve;

wherein said switch means comprises a first on/off switch for controlling the first on/off valve, and a second on/off switch for controlling the second on/off valve said first on/off switch and said second on/off switch being mounted on a control panel; and wherein said signal means comprises a first contact member connected to the float and a second contact member connected to the primary container, and a warning signal light connected to the control panel and being electrically connected to the first and the second contact members such that the signal light is illuminated when the first and the second contact members contact each other.

16. A beverage dispensing system for uninteruptedly serving beverages by permitting remote switching from a nearly emptied primary beverage container to a full secondary beverage container, said beverage dispensing system comprising:

a primary beverage container and a secondary beverage container, each beverage container containing a beverage therein;

a beverage dispenser;

conduit means connected between the primary beverage container and the dispenser and between the secondary beverage container and the dispenser for directing the beverages from the primary container and the secondary container to the beverage dispenser;

sensing means for sensing the amount of beverage within the primary beverage container, wherein said sensing means comprises a first float disposed inside of the primary beverage container and a second float disposed inside of the second beverage container;

signal means actuated by said first and second floats for generating a signal when a predetermined amount of beverage remains within the primary and secondary containers;

control means for controlling flow through the conduit means, said control means having an initial configuration where the beverage is allowed to flow from the primary container to the beverage dispenser and the beverage within the secondary container is prevented from flowing to the beverage dispenser, and said control means having a back-up configuration where the beverage is prevented from flowing from the primary container to the dispenser and the beverage is allowed to flow from the secondary container to the dispenser, the configuration of said control means being changed from the initial configuration to the back-up configuration by an operator when the sensing means senses that there is a predetermined amount of beverage remaining within the primary container;

wherein said control means comprises a first on/off valve in the conduit means between the primary container and the dispenser, and a second on/off valve in the conduit means between the secondary container and the dispenser, and switch means for controlling said first on/off valve and said second on/off valve;

wherein said switch means comprises a first on/off switch for controlling the first on/off valve and a second on/off switch for controlling the second on/off valve, said first on/off switch and said second on/off switch being mounted on a control panel;

wherein said signal means comprises a first contact member connected to the float and a second contact member connected to the primary container, and a first signal light connected to the control panel and being electrically connected to the first and the second contact members such that the first signal light is illuminated when the first and the second contact members contact each other;

wherein said signal means comprises a third contact member connected to the float, a fourth contact member connected to the secondary container, and a second signal light connected to the control panel and being electrically connected to the first and the second contact members such that the second signal light is illuminated when the third and the fourth contact members contact each other;

wherein a lid of each of said containers comprises a plate, a pair of generally cylindrical cap members each of said cap members resting on a respective container and having a closed upper end, a perimeter sidewall and an interior being defined by said sidewall;

a fastener coupling each of said cap members to said plates of said containers;

a vent hole extending through each of the lids;

a pair of cylindrical sleeves, each of the sleeves being downwardly extended from a respective lid of the containers, each of the floats comprising a hollow float member and a shaft connected to a top thereof, each of the shafts being slidably received in the respective sleeve and extending into the interior of the respective cap member;

the first and third contact members being coupled to a top of the respective sleeve, the shafts of the floats extending through an aperture in the first and third contact members; and the second and fourth contact members being coupled to a top of the respective shaft.

* * * * *